United States Patent [19]

Fisher

[11] 4,202,507

[45] May 13, 1980

[54] CHUCK ASSEMBLY

[75] Inventor: Don E. Fisher, Pensacola, Fla.

[73] Assignee: Monsanto Company, St. Louis, Mo.

[21] Appl. No.: 974,651

[22] Filed: Dec. 29, 1978

[51] Int. Cl.[2] ..... B65H 54/54

[52] U.S. Cl. ..... 242/46.2; 242/46.6

[58] Field of Search ..... 242/46.2, 46.3, 46.4, 242/46.5, 46.6, 72 R, 68, 68.1, 68.2, 68.3, 129.5, 129.7, 130, 130.1; 279/1 Q, 2

[56] References Cited

U.S. PATENT DOCUMENTS

| | | | |
|---|---|---|---|
| 1,884,805 | 10/1932 | Moritz | 242/46.2 |
| 1,974,002 | 9/1934 | Anderson | 242/46.3 |
| 2,464,024 | 3/1949 | Carter et al. | 242/46.2 |
| 3,081,960 | 3/1963 | Howe | 242/46.2 X |
| 3,820,739 | 6/1974 | Graf | 242/46.4 |
| 4,049,210 | 9/1977 | Pierce | 242/46.6 X |

FOREIGN PATENT DOCUMENTS

| | | | |
|---|---|---|---|
| 1123048 | 6/1956 | France | 242/46.2 |
| 326118 | 1/1958 | Switzerland | 242/46.6 |
| 326497 | 2/1958 | Switzerland | 242/46.6 |
| 361175 | 5/1962 | Switzerland | 242/46.2 |
| 716045 | 9/1954 | United Kingdom | 242/46.6 |

*Primary Examiner*—Stanley N. Gilreath
*Attorney, Agent, or Firm*—Kelly O. Corley

[57] ABSTRACT

In a chuck with two O-rings for engaging a bobbin, the bobbin being positioned on the chuck clears the outboard O-ring but compressingly engages the inboard O-ring. Movement of the inboard O-ring is used to expand the outboard O-ring into contact with the bobbin.

8 Claims, 3 Drawing Figures

CHUCK ASSEMBLY

The invention relates to chucks for releasably gripping the inside of a cylindrical object, such as a bobbin on which yarn is to be wound.

Many variations of chucks are known to the art. Those made to operate at high speeds cannot have loose parts because vibration causes the parts to wear. The normal method of gripping the bobbin is to use some form of expanding or wedged part, or by some form of centrifugal grippers that protrude from the chuck due to centrifugal force. Known chucks are complicated and costly.

These and other problems with prior art chucks are avoided according to the present invention, which provides an inexpensive but precise chuck to replace the known prior complicated and expensive chuck designs.

According to a primary aspect of the invention, there is provided a chuck for supporting a replaceable element having a cylindrical inner surface comprising in combination an elongated support member having a supported inboard end at one end of its axis opposite a free outboard end at the other end of the axis, the support member having a maximum dimension transverse to the axis smaller than the diameter of the cylindrical inner surface whereby the replaceable element can be placed telescopingly on the support member; inboard resilient means mounted on the support member for movement therealong from a first position to a second position nearer the inboard end than the first position, the inboard means having dimensions selected such that when the replaceable element is telescopingly placed on the support member the inboard means is compressed between the surface and the support member and is moved to the second position; outboard resilient means mounted on the support member for movement therealong from a third position nearer the outboard end than the first position to a fourth position between the first and the third positions, the outboard means normally resting in a fifth position in a relatively unexpanded condition smaller than the cylindrical inner surface; and actuating means for moving the outboard means from the fifth to the third positions and for expanding the outboard means into compression against the surface, whereby the outboard means moves toward the fourth position while the inboard means moves toward the second position.

According to another aspect of the invention, the chuck further comprises a bearing supporting the support member for rotation about the axis.

According to another aspect of the invention, the first means is an O-ring.

According to another aspect of the invention, the second means is an O-ring.

According to another aspect of the invention, both the first and second means are O-rings.

According to another aspect of the invention, the actuating means is actuated by movement of the inboard means from the first position toward the second position.

According to another aspect of the invention, the O-ring in the second position lacks less than a half revolution of ending in its natural shape.

According to another aspect of the invention, the O-ring in the fourth position lacks less than a half revolution of ending in its natural shape.

Other aspects of the invention will in part appear hereinafter and will in part be obvious from the following detailed description taken in connection with the accompanying drawing, wherein.

Figure 1:
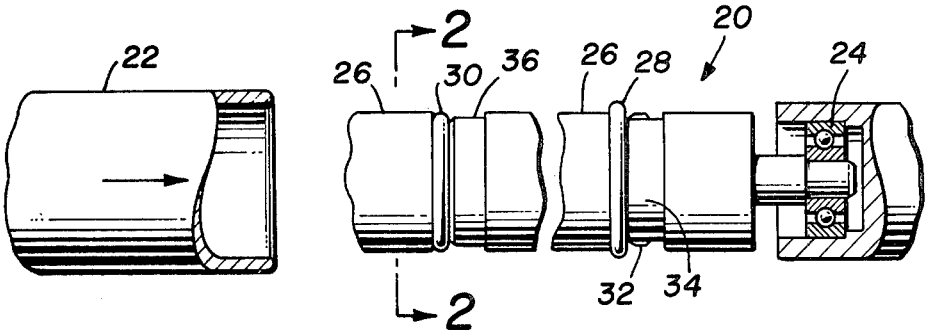
FIG. 1 is a schematic elevation view, partly in section, of the chuck according to the invention ready to receive a bobbin.

As shown in FIG. 1, chuck 20 is adapted for telescopingly receiving a replaceable element 22, illustrated as a bobbin having a cylindrical inner surface. In this application, chuck 20 is supported by bearings 24 in any conventional manner for rotation about its axis. Chuck 20 comprises four principal elements: an elongated support member 26 having a supported inboard end at one end of its axis (at the right in FIG. 1) and a free outboard end at the other end of its axis (at the left in FIG. 1), an inboard resilient means 28, an outboard resilient means 30 and an actuating means 32 shown in FIGS. 2 and 3. As will be explained, when bobbin 22 is telescopingly placed on support member 26, its circumference is sufficiently large to clear outboard resilient means 30, which is in a relatively unexpanded condition. However, inboard resilient means 28 protrudes far enough above the surface of support member 26 that it will be engaged and compressed by bobbin 22, and be moved from its first position as illustrated in FIG. 1 to a second position nearer the inboard end of support member 26. When resilient means 28 has thus been engaged, resilient means 30 is expanded into compression against the cylindrical inner surface of bobbin 22, then moves to the right as viewed in FIG. 1.

Figure 2:
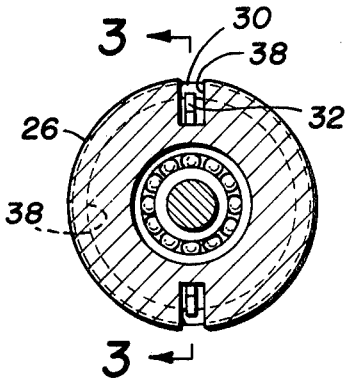
FIG. 2 is a vertical sectional view perpendicular to the chuck axis along line 2—2 of FIG. 1.
Figure 3:
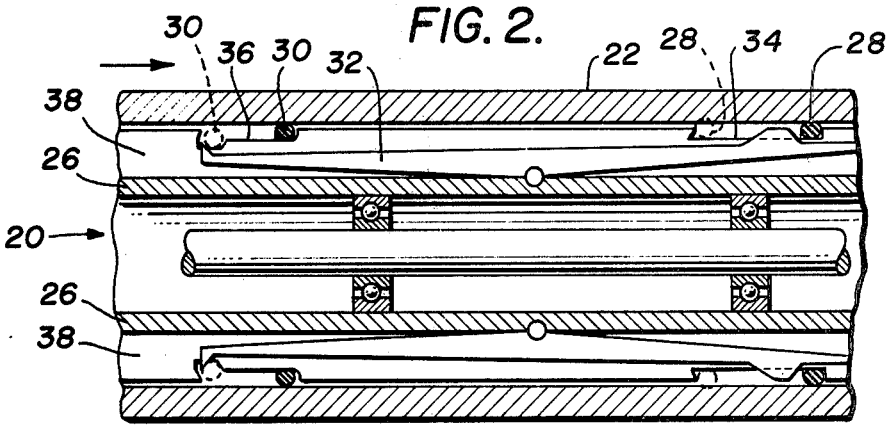
FIG. 3 is a vertical sectional view of the chuck parallel to and along the chuck axis along line 3—3 of FIG. 2.

The preferred embodiment is illustrated in FIGS. 2 and 3. As shown therein, inboard resilient means 28 and outboard resilient means 30 and each O-rings in respective circumferential grooves 34 and 36 on support member 26. O-ring 28 has dimensions selected such that it will be compressed between the inner surface of bobbin 22 and the bottom of the inboard circumferential groove 34 as bobbin 22 is placed on chuck 20, and move with a rolling motion from a first position, shown in dotted lines in FIG. 3, to a second position nearer the inboard end of support member 26 than the first position, shown in solid lines in FIG. 3.

Outboard circumferential groove 36 likewise provides for movement of O-ring 30 from a third position nearer the outboard end of support member 26 (just to the right of the position of O-ring 30 in dotted lines) than the first position of O-ring 28 to a fourth position between the third and first positions. O-ring 30 normally rests (in the absence of bobbin 22) in a fifth position indicated in dotted lines. The fifth position is provided by a deepened portion in the outboard region of outboard groove 36. When in the fifth position, O-ring 30 is in a relatively unexpanded condition smaller than the cylindrical inner surface of bobbin 22.

In the preferred embodiment, actuating means 32 is in the form of a lever riding in an axial groove 38 deeper than and connecting circumferential grooves 34 and 36. The opposite ends of lever 32 underlie O-rings 28 and 30, and the surface of lever 32 contacting the bottom of groove 38 is convex whereby lever 32 can pivot or rock in the plane of groove 38.

Operation of the preferred embodiment is as follows. Before bobbin 22 is telescopingly placed on chuck 20, O-rings 28 and 30 will be in the first and fifth positions, as indicated in dotted lines in FIG. 3. Since O-ring 30 is in its relatively unexpanded condition, bobbin 22 slips past O-ring 30. However, O-ring 28 protrudes far enough radially outwardly to be compressed and driven toward the second position. As O-ring 28 rolls to the right, as viewed in FIG. 3, it depresses the inboard end of lever 32, raising the outboard end of lever 32 and simultaneously expanding and moving O-ring 30 to the third position. At the third position, O-ring 30 becomes compressed between the inner surface of bobbin 22 and the larger diameter portion of groove 36. As bobbin 22 is further urged on chuck 20, O-ring 30 rolls from the third toward the fourth position while O-ring 28 continues toward the second position.

Preferably the O-rings are rolled so that their final positions lack less than a half revolution of ending in their natural shape, which assists in holding the bobbin on the chuck. This preferred final position may be provided for by the end of the circumferential groove in which the O-ring rides, as illustrated, by a flange on support member 26 for preventing further axial movement of bobbin 22 toward the inboard end of chuck 20, or by other means which will occur to those skilled in the art.

What is claimed is:

1. A chuck for supporting a replaceable element having a cylindrical inner surface, comprising, in combination:

a. an elongated support member having a supported inboard end at one end thereof and a free outboard end at the other end thereof, said support member having a maximum dimension transverse to said axis smaller than the diameter of said cylindrical inner surface whereby said replaceable element can be placed telescopingly on said support member;

b. inboard resilient means mounted on said support member for movement therealong from a first position to a second position nearer said inboard end than said first position, said inboard means having dimensions selected such that when said replaceable element is telescopingly placed on said support member said inboard means is compressed between said surface and said support member and is moved to said second position;

c. outboard resilient means mounted on said support member for movement therealong from a third position nearer said outboard end than said first position to a fourth position between said first and said third positions, said outboard means normally resting in a fifth position in a relatively unexpanded condition smaller than the diameter of said cylindrical inner surface; and d. actuating means for moving said outboard means from said fifth position to said third position and for expanding said outboard means into compression against said surface, whereby said outboard means moves from said fifth position to said third position and subsequently toward said fourth position while said inboard means moves toward said second position.

2. The chuck defined in claim 1, further comprising a bearing supporting said support member for rotation about said axis.

3. The chuck defined in claim 1, wherein said inboard means is an O-ring.

4. The chuck defined in claim 1, wherein said outboard means is an O-ring.

5. The chuck defined in claim 1, wherein both said inboard and said outboard means are O-rings.

6. The chuck defined in claim 1, wherein said actuating means is actuated by movement of said inboard means from said first position toward said second position.

7. The chuck defined in claim 3, wherein said O-ring rolls along said support member when moving from said first position to said second position and lacks less than a half revolution of ending in its natural shape when in said second position.

8. The chuck defined in claim 4, wherein said O-ring rolls along said support member when moving from said third position to said fourth position and lacks less than a half revolution of ending in its natural shape when in said fourth position.

* * * * *

UNITED STATES PATENT AND TRADEMARK OFFICE

CERTIFICATE OF CORRECTION

PATENT NO. : 4,202,507

DATED : May 13, 1980

INVENTOR(S) : Don E. Fisher

It is certified that error appears in the above-identified patent and that said Letters Patent are hereby corrected as shown below:

Column 2, line 40, "and" should read --are--.

Signed and Sealed this

*Twenty-second* Day of *July 1980*

[SEAL]

*Attest:*

SIDNEY A. DIAMOND

*Attesting Officer*

*Commissioner of Patents and Trademarks*